US008939736B2

(12) United States Patent
Israelson et al.

(10) Patent No.: US 8,939,736 B2
(45) Date of Patent: Jan. 27, 2015

(54) FUEL PUMP ASSEMBLY

(75) Inventors: Kevin L. Israelson, Cass City, MI (US); Douglas W. Salowitz, Jr., Palms, MI (US); David L. Speirs, Cass City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 353 days.

(21) Appl. No.: 13/307,879

(22) Filed: Nov. 30, 2011

(65) Prior Publication Data

US 2013/0133765 A1 May 30, 2013

(51) Int. Cl.
*F04B 17/03* (2006.01)

(52) U.S. Cl.
USPC ..... 417/410.4; 417/310; 417/423.2

(58) Field of Classification Search
USPC ..... 417/410.1, 410.4, 423.2, 423.11, 310
See application file for complete search history.

(56) References Cited

U.S. PATENT DOCUMENTS

| | | | | |
|---|---|---|---|---|
| 3,029,081 | A * | 4/1962 | Marsh | 277/368 |
| 4,471,802 | A * | 9/1984 | Pryor | 137/454.2 |
| 4,541,454 | A * | 9/1985 | Sturman et al. | 137/505.41 |
| 4,596,519 | A | 6/1986 | Tuckey | |
| 5,421,306 | A | 6/1995 | Talaski | |
| 5,785,032 | A * | 7/1998 | Yamashita et al. | 123/509 |
| 6,196,200 | B1 | 3/2001 | Roche | |
| 6,231,318 | B1 * | 5/2001 | Cotton et al. | 417/423.1 |
| 6,279,235 | B1 * | 8/2001 | White et al. | 30/276 |
| 7,475,678 | B2 | 1/2009 | Douyama et al. | |
| RE41,182 | E * | 3/2010 | Cotton et al. | 439/733.1 |
| 2003/0131828 | A1 * | 7/2003 | Crary | 123/509 |
| 2004/0101427 | A1 | 5/2004 | Yu et al. | |
| 2007/0025866 | A1 * | 2/2007 | Douyama et al. | 417/423.3 |
| 2008/0251149 | A1 | 10/2008 | Boutros et al. | |

FOREIGN PATENT DOCUMENTS

| | | | | |
|---|---|---|---|---|
| JP | 2002-333924 | | 11/2002 | |
| JP | 2002333924 | A * | 11/2002 | G05D 16/02 |
| WO | W02008075035 | A1 | 6/2008 | |

OTHER PUBLICATIONS

Machine English Translation for reference Patent JP-2002-333924; Inventor: Nakamura, Mutsumi; Assignee: Yazaki Corp; Publication Date: Nov. 22, 2002.*

Written Opinion & International Search Report for PCT/US12/063833, Mar. 25, 2013, 14 pages.

* cited by examiner

*Primary Examiner* — Bryan Lettman
(74) *Attorney, Agent, or Firm* — Reising Ethington P.C.

(57) ABSTRACT

A fuel pump assembly may include a housing and a fuel pump within a fuel pump cavity. The fuel pump may include a motor, a pumping element driven for rotation by the motor, a pump body that maintains the position of the pumping element relative to the motor and the housing, and a flexible seal. The seal may be disposed between the pump body and the housing to provide a fluid tight seal between them. A portion of the seal may be disposed radially outwardly of a distal end of the pump body to radially position the pump body within the fuel pump cavity and a portion of the seal may be disposed axially outwardly of the distal end of the pump body to axially position the pump body within the fuel pump cavity.

22 Claims, 14 Drawing Sheets

FUEL PUMP ASSEMBLY

TECHNICAL FIELD

The present disclosure relates generally to fuel delivery systems and more particularly to a fuel pump assembly.

BACKGROUND

Fuel systems for combustion engines can sometimes include a fuel pump assembly that pumps fuel from a fuel tank to an engine. The fuel pump generally is carried by some structure either within or outside of the fuel tank. Fuel is taken into the fuel pump through an inlet, the pressure of the fuel is increased, and the fuel is discharged from the fuel pump and delivered to the engine.

SUMMARY

In one form, a fuel pump assembly may include a housing defining a portion of a fuel pump cavity and a fuel pump within the fuel pump cavity. The fuel pump may include a motor, a pumping element driven for rotation by the motor, a pump body having a first end adjacent to the motor and a distal end spaced from the motor, wherein the pump body maintains the position of the pumping element relative to the motor and the housing, and a flexible seal. The seal may be disposed between the pump body and the housing to provide a fluid tight seal between them. A portion of the seal may be disposed radially outwardly of the distal end of the pump body to radially position the pump body within the fuel pump cavity and a portion of the seal may be disposed axially outwardly of the distal end of the pump body to axially position the pump body within the fuel pump cavity.

A fuel pump assembly may include a housing defining at least a portion of a fuel pump cavity and a fuel pump disposed within the fuel pump cavity. The fuel pump may include an electric motor including a drive shaft, a pumping element coupled to and driven for rotation by the drive shaft and a pump body having a bore through which the drive shaft extends, and including a locating feature for the pumping element where the locating feature is formed in one piece with the pump body.

A fuel pressure regulator may include a housing defining a valve seat, a valve head movable relative to the valve seat to control fuel flow through the fuel pressure regulator, and a vent passage defined in one or both of the housing and the valve head to enable vapor flow through the fuel pressure regulator even when the valve head is engaged with the valve seat.

In at least one implementation, a fuel pump assembly may include a main housing, a fuel pump and a fuel pressure regulator. The main housing may define at least part of a fuel pump cavity and the fuel pump may be located at least partially within the fuel pump cavity. The fuel pump may have a metal casing, an electric motor received at least partially within the casing and having a drive shaft, a negative terminal and a positive terminal to which wires are connected to provide power to the motor to rotate the drive shaft, a pumping element coupled to and driven for rotation by the drive shaft to discharge fuel under pressure through an outlet, and a ground element coupled to the negative terminal and a wire coupled to the negative terminal, and having a portion engaging the metal casing. The fuel pressure regulator may be carried by the main housing downstream of the fuel pump and have a regulator housing with an inlet through which fuel discharged from the fuel pump is received, and a valve carried by the regulator housing to control the pressure of fuel downstream of the fuel pressure regulator. The main housing may have a groove adjacent to the fuel pressure regulator housing and in which a portion of the wire connected to the negative terminal is received, with a portion of the wire engaging the housing of the fuel pressure regulator.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 2:
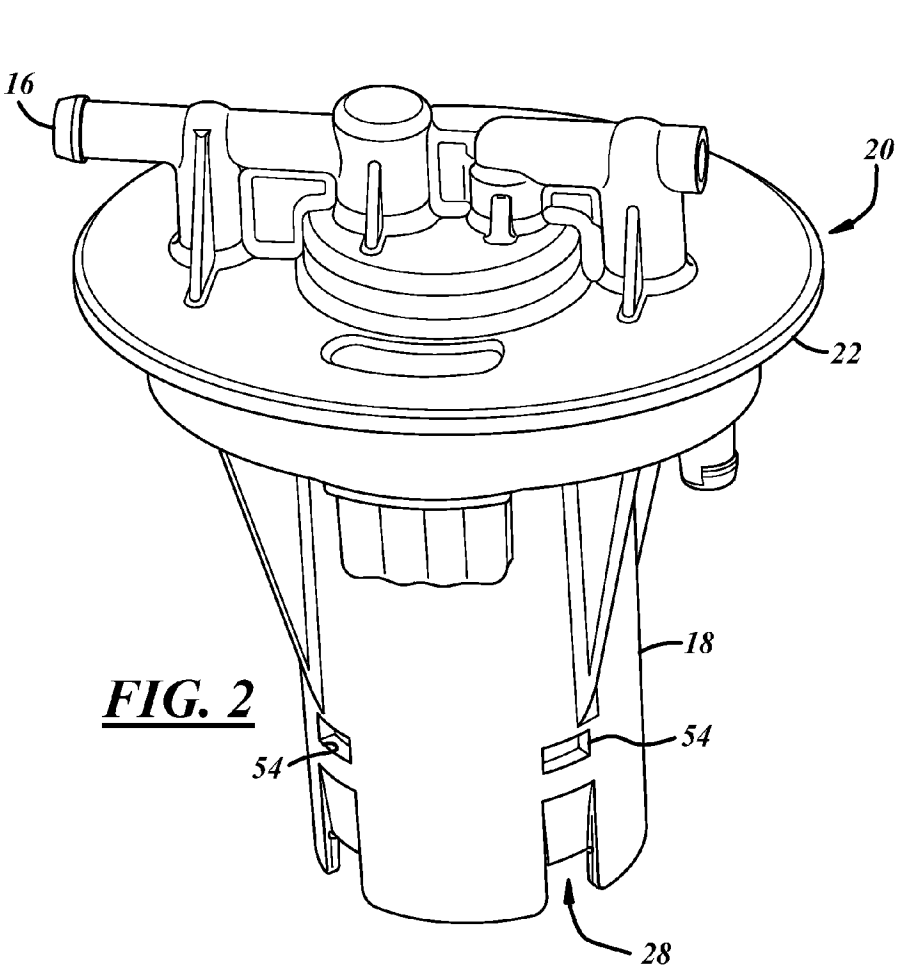
FIG. 2 is a perspective view of a portion of the fuel pump assembly of FIG. 1.
Figure 1:
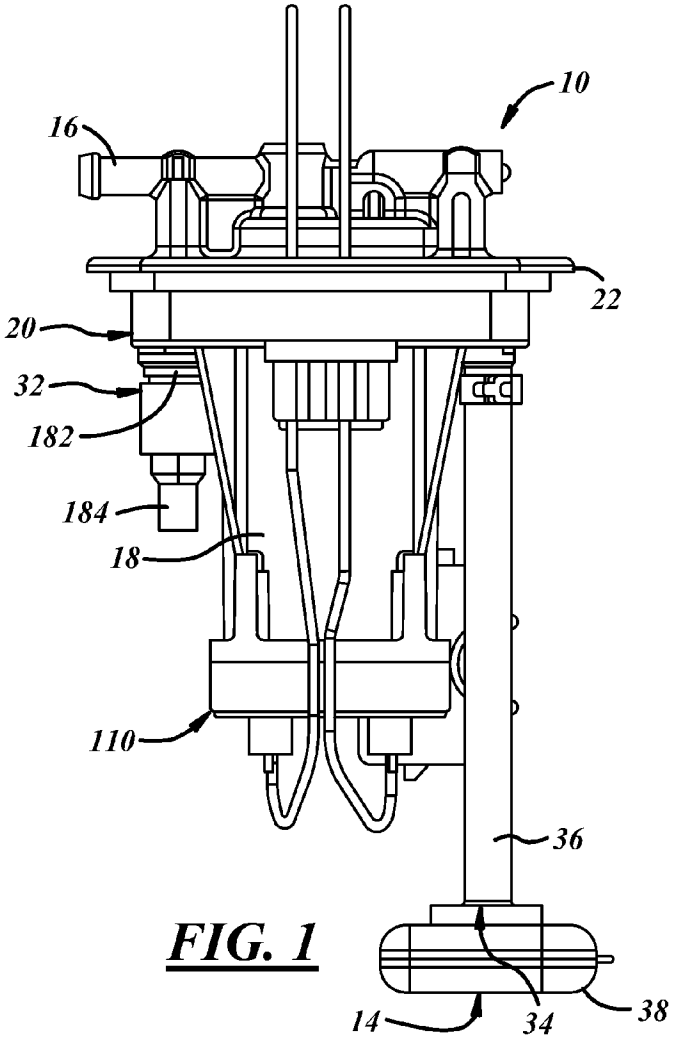
FIG. 1 is a side view of a fuel pump assembly including a mounting module and a fuel pump carried by the mounting module.
Figure 3A:
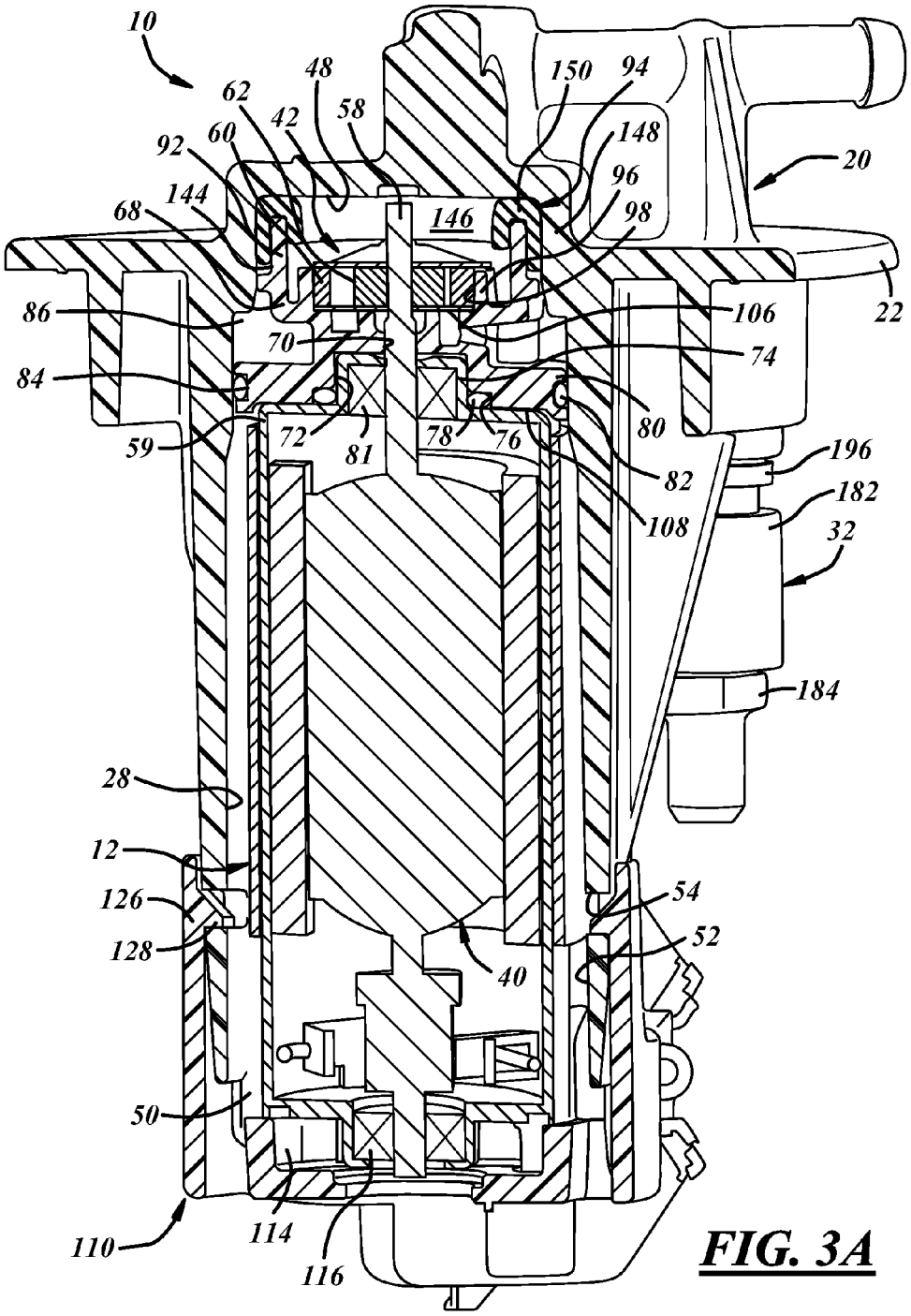
FIG. 3A is a cross sectional view of the fuel pump assembly of FIG. 1.
Figure 3B:
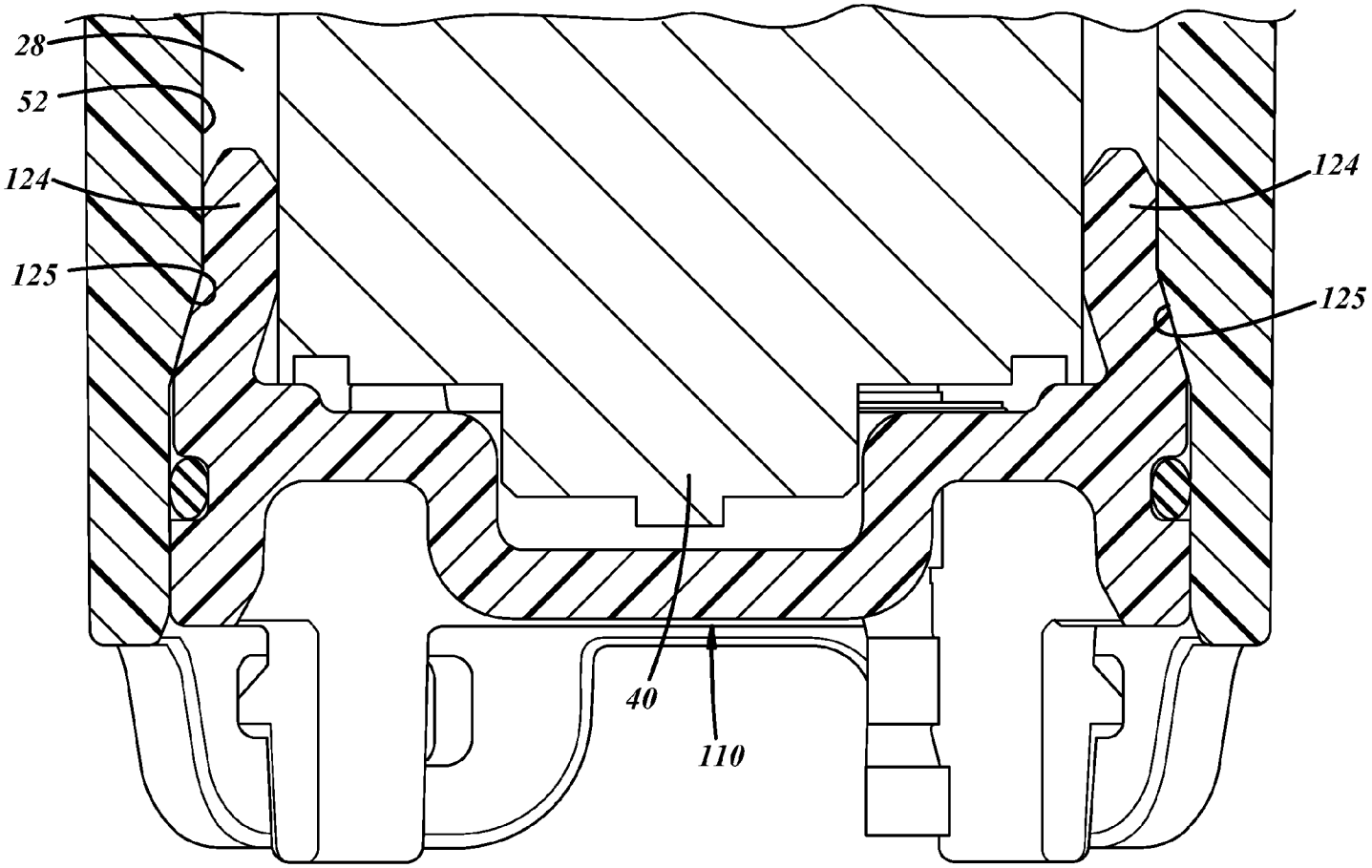
FIG. 3B is an enlarged section view of a lower portion of the fuel pump assembly.
Figure 4:
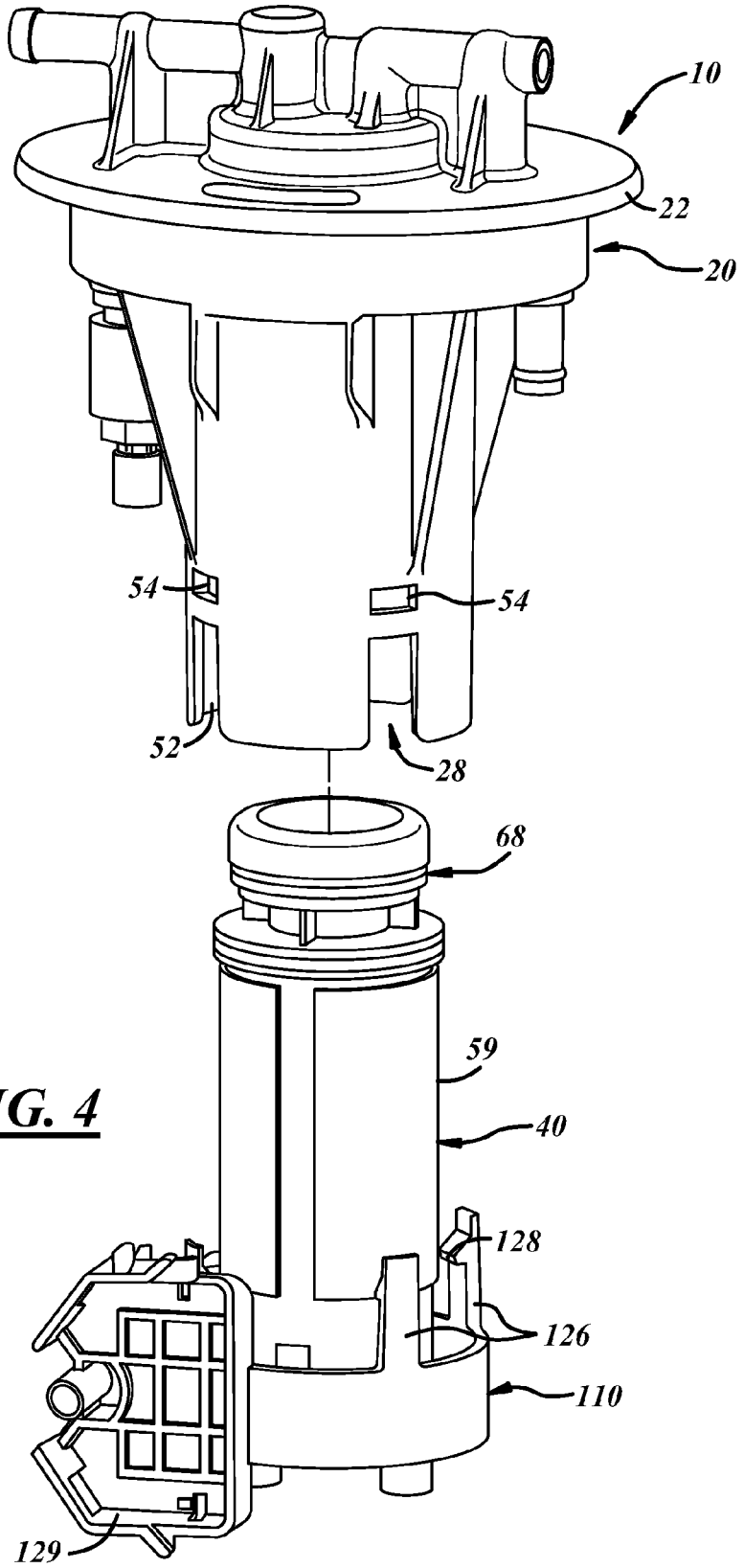
FIG. 4 is an assembly view of the fuel pump assembly.

Referring in more detail to the drawings, FIGS. 1-5 illustrates an exemplary embodiment of a fuel pump module 10 that may be mounted to a fuel tank with at least a portion of a fuel pump 12 communicated with an internal volume of a fuel tank. The module 10 may include an inlet 14 communicated with the interior of the fuel tank and through which fuel is taken in by the fuel pump 12, and an outlet 16 from which fuel is discharged under pressure from the module 10 and the fuel tank. Fuel discharged from the module 10 may be delivered to an engine to support operation of the engine. In one implementation, the module 10 includes an integral fuel pump housing 18 into which individual components of the fuel pump 12 are assembled and retained. In this manner, the fuel pump 12 may, but need not, have a separate casing or housing that interconnects and holds together the various components of the fuel pump 12.

Figure 5:
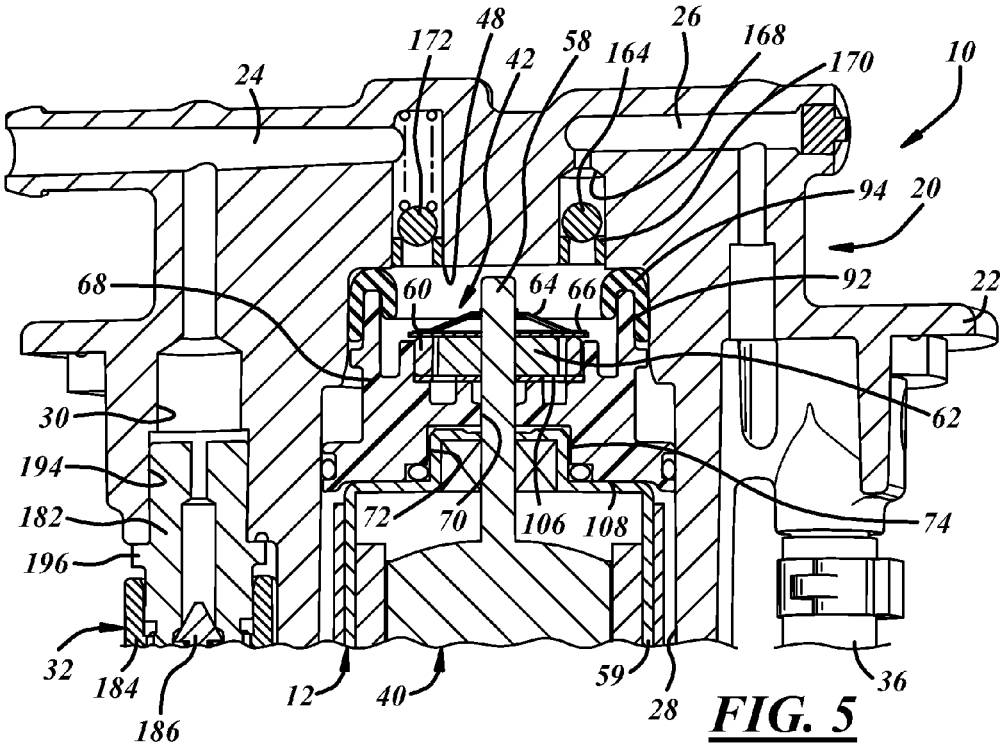
FIG. 5 is an enlarged, fragmentary sectional view of a portion of the fuel pump assembly.
Figure 6:
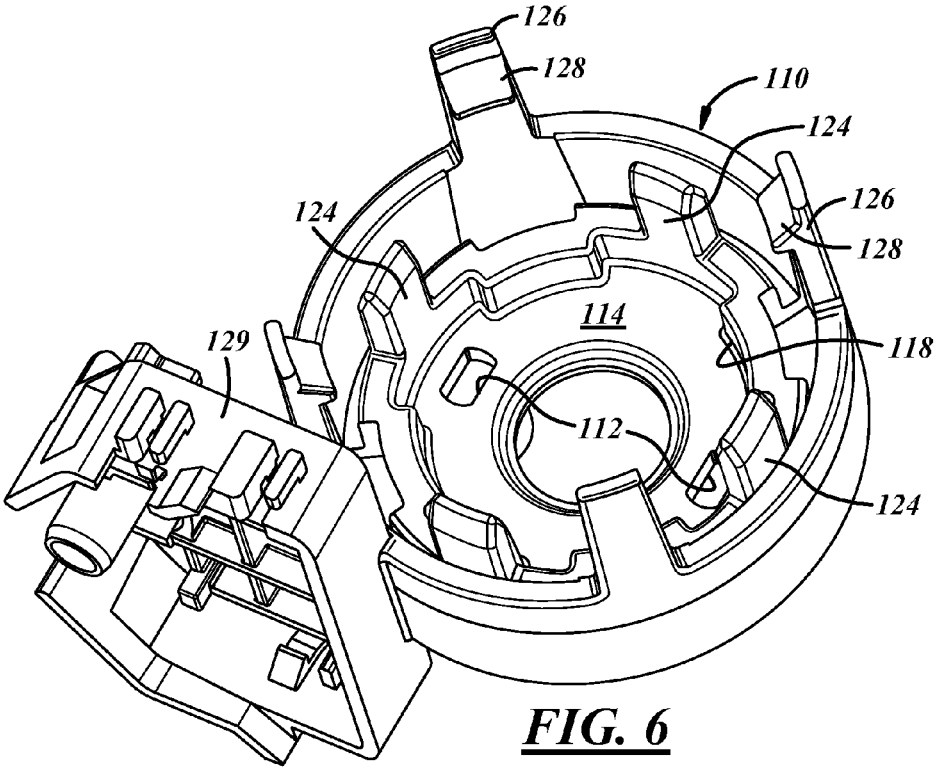
FIG. 6 is a perspective view of an end cap.

The module 10 may include a body or housing 20 with a radially outwardly extending flange 22 adapted to overlie and be sealed to a wall of the fuel tank. The flange 22 may be integrally formed in one piece with the module housing 20. The housing 20 may include various features adapted to receive or retain various components of the module 10, as well as molded in fuel passages to permit fuel to be routed among the various components of the module. As best shown in FIG. 5, the module housing 20 may include a fuel outlet passage 24, a vent passage 26, and a fuel pump cavity 28 in which at least some components of the fuel pump 12 are received in assembly. The module housing 20 may also include a branch passage 30 or other feature adapted to receive or be communicated with a fuel pressure regulator 32. An inlet opening 34 may be communicated with an inlet pipe 36 which, at its other end, carries a fuel filter 38 and defines the primary fuel inlet 14 of the module 10. Various other components or features may be carried or retained by the fuel pump module 10, for example, a fuel level indicator may be carried by the module body or any of its components, as can a fuel vapor vent valve, rollover valve or a fuel vapor canister, to name a few of the possible components.

Figure 9:
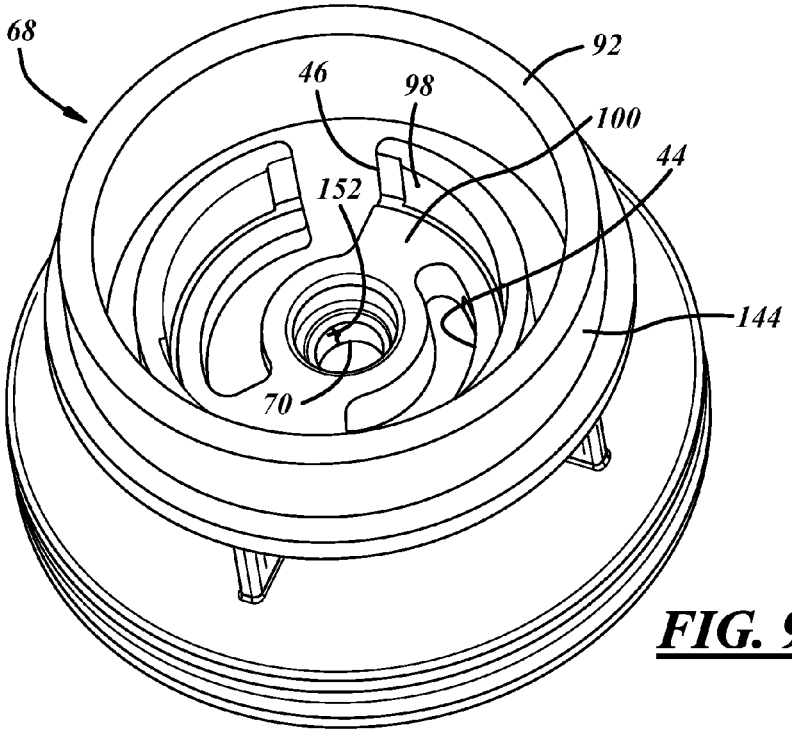
FIG. 9 is a bottom perspective view of an upper end cap.

The fuel pump cavity 28 may be an elongated, generally cylindrical cavity in which at least some and up to all of the fuel pump 12 may be received. The fuel pump 12 may include an electric motor 40 having either a turbine type impeller or a gear rotor set as the actual pumping element 42 that takes in fuel through an inlet 44 (FIG. 9), increases the pressure of the fuel, and discharges the fuel under pressure through an outlet 46 (FIG. 9). The fuel pump cavity 28 may be substantially closed at one end 48 and open at its other end 50 so that components of the fuel pump 12 may be assembled into the cavity 28 through the open end 50. The cavity 28 may include an inner wall 52 adjacent the open end 50 and a plurality of circumferentially spaced apart openings 54 near the open end 50.

The fuel pump motor 40 may include a drive shaft 58 that extends out of a motor casing 59 and is coupled to the pumping element 42 to drive the pumping element for rotation in use. In the implementation shown in FIGS. 3 and 5, a gear rotor type fuel pumping element 42 (sometimes called "gerotor") is used. The gerotor set may include an outer ring gear 60 and an inner drive gear 62 which have intermeshed teeth that define pumping chambers between them, as is known in the art. The inner drive gear 62 may be coupled to the drive shaft 58 by a clip 64 having resilient and radially extending fingers that engage and press a seal plate 66 against the gears 60, 62 (also called gerotors) to retain them in position and prevent or inhibit fluid leakage therefrom in use. The gerotors 60, 62, clip 64 and seal plate 66 may be of conventional construction.

Figure 20:
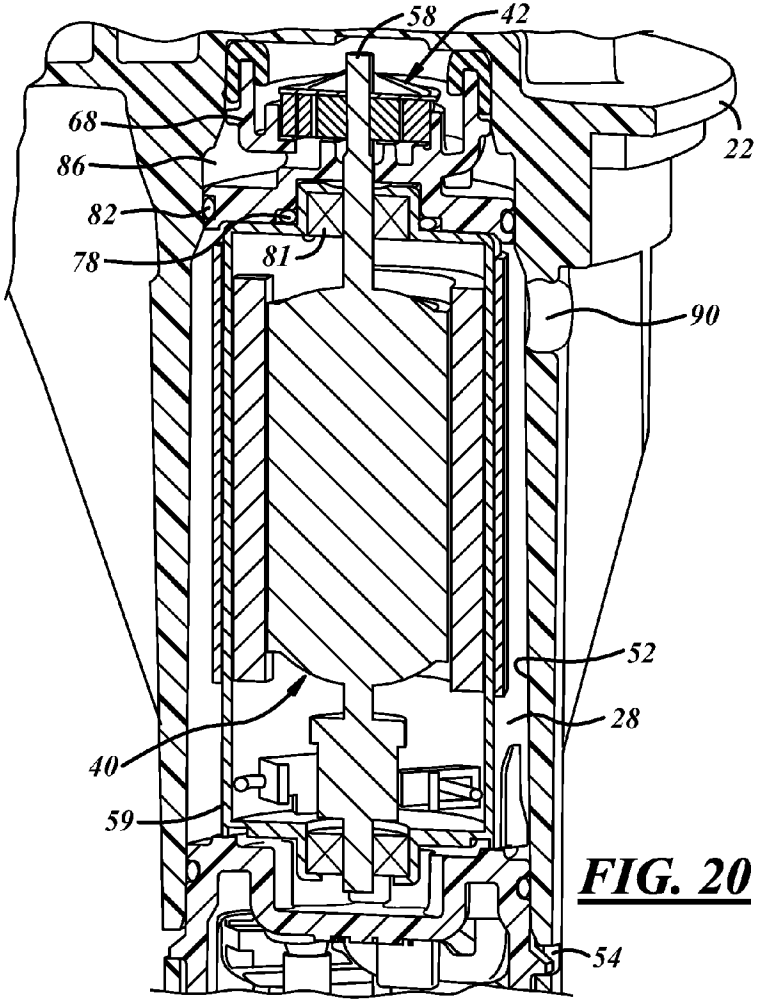
FIG. 20 is a cross sectional view of a fuel pump assembly with fuel pump cooling features.

As shown in FIGS. 3-5, 9 and 10, a pump body, which in the example of a gerotor type pump may be called a gerotor housing 68, may be disposed over one end of the pump casing 59 and have a main bore 70 through which the drive shaft 58 extends. At least a portion of the bore 70 may be lined with a bearing material, may carry a bearing, or material of the gerotor housing in at least a portion of the bore 70 may itself act as a bearing for the drive shaft 58. In that portion of the bore 70, the shaft 58 may be closely received in the bore with little slop or play between them to accurately locate the gerotor housing 68 relative to the shaft 58. A first counterbore 72 may receive a cylindrical boss 74 of the pump casing 59, a second counterbore 76 may receive a seal 78 surrounding the boss 74 and trapped between the second counterbore 76 and the casing 59. A radially outwardly extending flange 80 may receive a seal 82 trapped in a groove 84 formed in the flange 80 and against the inner wall 52 of the pump cavity 28. The seal 82 may prevent fluid leakage from a fuel pumping chamber 86 and allow the gerotor 60, 62 to develop a sub-atmospheric pressure to draw in fuel. As shown in FIG. 20, fluid may be permitted in the motor 40 and may flow or leak into the motor between the drive shaft 58, casing 59 and a bearing 81 carried by the motor 40. Seal 78 inhibits or prevents fuel from leaking between housing 68 and casing 59 and so fuel that passes shaft 58 must flow through the bearing 81. That fluid may fill the cavity 28 and may be vented out of the cavity and to the fuel tank through an opening 90 in the cavity wall, which may be provided at a desired height so that the cavity may fill with fuel up to the level of the opening. The fuel in the cavity 28 may help cool the fuel pump motor 40 in use. As shown in FIGS. 3, 5, 6 and 10, the gerotor housing 68 may also include an upstanding, generally cylindrical and annular upper flange 92 adapted to trap an annular seal 94 between the flange and the end wall 48 of the fuel pump cavity 28. The gerotor housing 68 may be molded from any suitable plastic material, or it may be formed of metal.

To locate and facilitate retaining the gerotors 60, 62, a locating feature, shown here as a locating wall 96, may be formed integrally and in one-piece with the gerotor housing 68 and spaced radially inwardly from the upper flange 92. The locating wall 96 may include an inner surface 98 that, in assembly, positions the outer gear 60 of the gerotor set eccentrically spaced from and not coaxial with the inner gear 62 and an axis of rotation of the drive shaft 58. When the locating wall 96 is formed integrally with the rest of the gerotor housing 68, the locating wall may accurately be located relative to, for example, the bore 70 through which the drive shaft 58 extends. Because the axis of the drive shaft 58 defines the axis about which the inner gear 62 rotates, the locating wall 96 can therefore be accurately located relative to the axis of rotation of the gerotor set 60, 62 to reduce variances between pumps and improve consistency of the pumps 12. A base wall 100 (FIG. 9) may extend generally perpendicular to the locating wall 96 to define a cavity (hence, the locating wall may define a sidewall of the cavity) in which the gerotor set 60, 62 is received in assembly. The motor 40 may be located on the opposite side of the base wall 100 as the gerotor cavity which may facilitate forming the main bore 70 (e.g. with a pin or post in one half of a mold) and also precisely locating the gerotor cavity relative to the main bore 70 (e.g. by a mold feature in the other half of the mold). The base wall 100 may include the inlet 44 such a slot or hole through which fuel is received at a relatively low pressure, and the outlet 46 circumferentially spaced from the inlet 44 and through which fuel is discharged from the pumping element 42 under pressure. In the area of the outlet 46, the locating wall 96 may be discontinuous or include a slot or opening therein through which fuel may flow away from the pumping element 42. A seal 106, having openings aligned with the inlet and outlet of the base wall 100 may be disposed between the base wall and the gerotor set 60, 62 in use. A base 108 of the gerotor housing 68 between the seals 78, 82, may be engaged by the motor casing 59 in assembly to push the gerotor housing 68 toward the end wall 48 of the fuel pumping cavity 28.

At the other end of the motor 40, an end cap or retainer 110 may be coupled to the module housing 20 spanning at least a portion of the open end 50 of the pump cavity 28, to retain the fuel pump 12 within the pump cavity 28. The retainer 110 may include a pair of openings or passages 112 through which electrical wires may pass to be coupled to the positive and negative terminals of the motor 40. A cavity or opening 114 may be provided for a bearing 116 that journals for rotation an end of the drive shaft 58. An inner surface 118 of the retainer 110 may be contoured to receive the corresponding end of the motor 40. One or more locating pegs 124 may extend axially from an inner surface of the retainer 110 to engage ramp surfaces 125 (FIG. 3B) of the pump cavity 28 to flex the pegs 124 radially inwardly as the retainer 110 is axially advanced relative to the pump cavity 28 to center the pump motor 40 within the pump cavity 28. The alignment pegs 124 on the retainer 110 are preferably radially outwardly spaced from a lower edge of the fuel pump motor casing 59 so that the pegs 124 are not engaged by the motor casing 59 which may otherwise scrape the pegs and result in debris within the fuel pump cavity 28 and the assembly in general. To retain the axial position of the pump 12 relative to the module housing 20, a plurality of fingers 126 may extend upwardly from the retainer 110, at a location spaced radially outwardly of the pegs 124. The fingers 126 may include radially inwardly extending tabs 128 adapted to be received within openings 54 in the periphery of the pump cavity 28 when the retainer 110 is fully advanced relative to the pump cavity 28. The diameter defined between the inward edges of the tabs 128 is less than the outer diameter of the wall defining the pump cavity 28. Therefore, as the retainer 110 is advanced relative to the cavity 28, the tabs 128 engage the outer surface of the pump cavity 28 and flex the fingers 126 outwardly until the tabs 128 are axially aligned with the openings 54. Then, the tabs 128 enter the openings 54 to couple the retainer 110 to the module housing 20. With the pump 12 engaged with the retainer 110, axially positioning the retainer 110 on the module housing 20 also axially positions the pump 12 within the pump cavity 28. The retainer 110 may also include a body 129 adapted to receive a portion of a fuel level sensor, such as a wiper and resistor card assembly. The body may be formed in one piece with the retainer 110 so they are integral unit.

Figure 7:
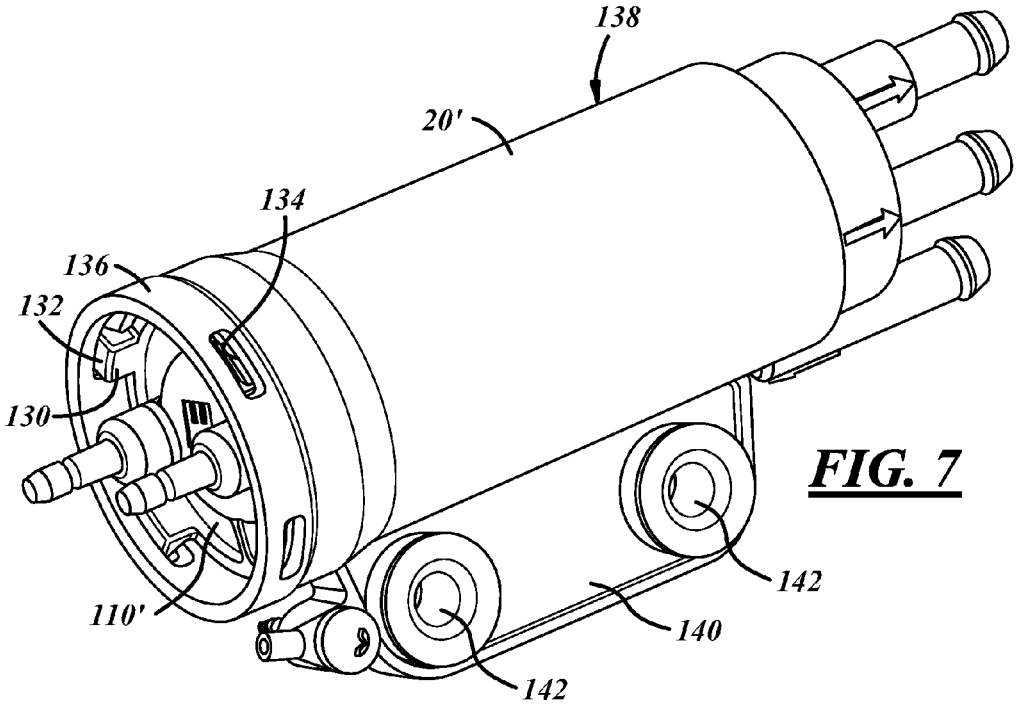
FIG. 7 is a perspective view of an inline fuel pump assembly.
Figure 8:
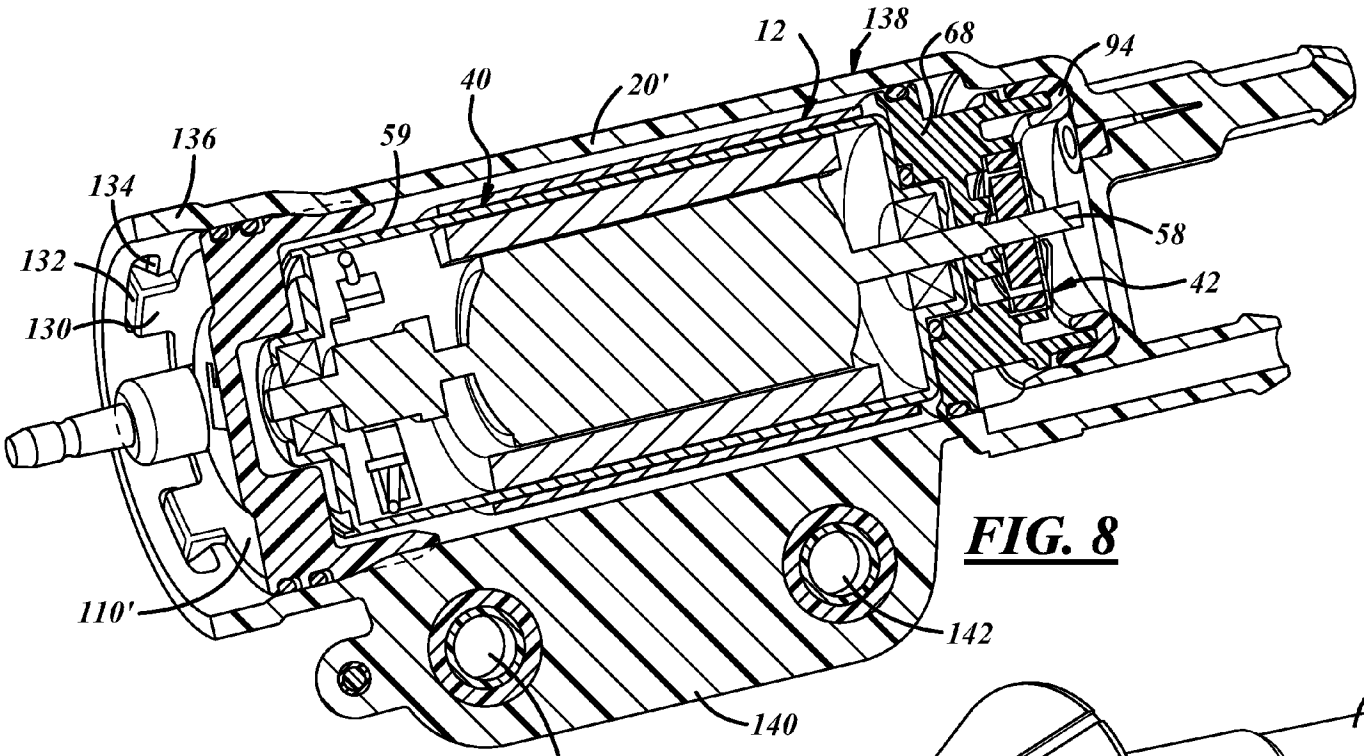
FIG. 8 is a cross sectional view of the inline fuel pump assembly.

A retainer 110' may also be formed for receipt more within the cavity 28, as shown in FIGS. 7, 8, 11 and 12. Axially extending feet 130 may extend from the retainer 110' and may have laterally or radially outwardly extending tips 132 that are adapted to be snap fit into an opening 134 in the sidewall 136 of the pump cavity 28. Desirably, when the feet 130 are snapped fit into the openings 134 of the sidewall 136 the axial position of the fuel pump assembly is fixed. FIGS. 7 and 8 also show an alternate housing 20' that houses only the pump 12 and not other components, although other components could also be carried or housed by the housing 20' as shown, the fuel pump assembly 138 of FIGS. 7 and 8 (including the housing 20', retainer 110', and pump 12) could be located anywhere along the fuel line between the tank and engine, such as in, on or downstream of the tank. A mounting flange 140 and mounting holes 142 may be provided to facilitate mounting the assembly 138 to an adjacent component or structure. The fuel pump, gerotor housing and other related components may all be as described with regard to the fuel pump module 10.

To accommodate variations in the axial dimension of the pump motor 40, retainer 110, and gerotor housing 68 within a production run of these components, the seal 94 disposed between the upper flange 92 and the end wall 48 of the fuel pump cavity 28 preferably is formed from a resilient and at least somewhat compressible material of sufficient axial thickness to accommodate variations in the total axial length of the fuel pump assembly. In other words, for a given fuel pump assembly of longer than average dimension due to manufacturing tolerance stack-up, the seal 94 will be compressed more than for a shorter fuel pump assembly. For any anticipated axial length of fuel pump, the seal 94 preferably provides a liquid tight seal between the gerotor housing 68 and the fuel pump cavity 28, and also provides sufficient axial force holding the fuel pump components together in use. The seal 94 also provides a damping material which isolates the fuel pump 12 from the module housing 20 from noise and vibrations in use. In the implementation shown, the seal 94 also circumferentially surrounds an outer periphery of the upper flange 92 and also provides a seal between a side surface 144 of the upper flange 92 and the fuel pump cavity 28, while also accommodating some radial displacement of the gerotor housing 68, and helping to center and align the gerotor housing 68 within the fuel pump cavity 28. Accordingly, the seal 94 provides both an axial and radial seal between the gerotor housing 68 and the fuel pump cavity 28, and also helps to axially and radially align and retain the gerotor housing 68 relative to the fuel pump cavity 28. The seal 94 may be annular, and it may be in the shape of an inverted U, or an inverted J (as shown in the drawings), with a groove defined between radially inner and outer rings of the seal 146, 148, respectively, where the inner and outer rings 146, 148 are joined together by an axially extending base 150. At least the inner ring 146 is optional and may be provided to facilitate retaining the seal 94 on the gerotor housing 68 to facilitate assembly of the pump into the pump cavity 28.

There may be clearance between the cylindrical boss 74 of the motor casing 59 and the cavity of the gerotor housing 68 in which it is received, the radial alignment between the gerotor housing 68 and the motor casing 59 may occur by the engagement of the drive shaft 58 with the bore 70 through which it extends. Accordingly, the drive shaft 58 can be accurately aligned with the gerotor housing 68 and the gerotor set 60, 62 with variances in the dimensions of the cylindrical boss 74 not effecting the axial alignment of these components. In the implementation shown, the bearing surface or area 152 between the gerotor housing 68 and the shaft 58 is disposed within the fuel pump cavity 28 so that fuel flows through the bearing area 152 to lubricate and reduce wear of the bearing area. The locating wall 96 may be provided on the same side of the mold or die used to form the gerotor housing 68 as the hole 70 so that these features may be accurately located relative to each other to improve the axial alignment of the shaft 58, hole 70 and gerotor set 60, 62.

In at least some implementations, the outlet of the fuel pump 12 may be communicated with the pressure regulator 32 via the fuel outlet passage 24 formed in the housing 20 and a vent valve 164 via the vent passage 26, as shown in FIG. 5. The vent valve 164 may be a ball valve moveable against a first seat 168 to close the vent passage 26 when the fuel pump 12 is pumping fuel, and which rests on a second seat 170 when the fuel pump is not operating. Should vapor pressure develop within the fuel pump 12 when it is not operating, the vent valve 164 may be moved off the second seat 170 to vent vapor from of the fuel pump 12. Such vapor flow is routed back to the tank via the vent passage 26. A check valve 172 may be disposed in the primary outlet passage 24. The check valve 172 permits fluid flow out of the pump 12, but prevents fluid flow back into the pump, to prevent a back flow of fuel through the pump when the pump is turned off and to maintain the pressure of fuel in the fuel line downstream of the check valve 172 even when the fuel pump 12 is not operating.

The fuel pressure regulator 32 may be in communication with the flow of fluid discharged from the fuel pump 12 and from the module 10. The pressure regulator 32 may be located in the branch passage 30 that is connected to the fuel outlet passage through a "T" or in any other desired way. The pressure regulator 32 may be a flow through type regulator that, when acted on by a fuel at a pressure higher than desired for delivery to the engine, permits some of the fuel discharged from the fuel pump 12 to be returned to the fuel tank through the pressure regulator outlet 204. Fuel at the desired pressure for delivery to the engine does not flow through the pressure regulator 32 and instead flows out of the primary fuel outlet passage 24 for delivery to the engine.

The pressure regulator 32 includes a housing with an inlet body 182 and an outlet body 184, and a valve body 186 is carried between the inlet and outlet bodies. The inlet body 182 includes an inlet passage 188, a valve seat 190 surrounding the inlet passage and a connection feature 192 at one end. The inlet body 182 may have a first end received within a counterbore 194 of the branch passage 30 and a second end that includes the connection feature, which, in one form, may include exterior threads 192. The inlet body 182 may also have an outwardly extending flange 196 adapted to engage the module 10 to limit insertion of the inlet body 182 into the counterbore 194. And an exterior groove 198 may be formed in the inlet body 182 between the flange 196 and second end, and adapted to receive a seal such as an o-ring 200. The inlet body 182 may be formed of a metal or any other suitable material including plastics, and could be an integral part of the housing 20 or its flange 22 rather than a separate component.

The outlet body 184 may include a cavity 202 defined by a sidewall that is open at one end. An outlet passage 204 may communicate with the cavity, and a valve retainer 206 may be carried by or formed in one piece with the outlet body 184. The valve retainer 206 may include an annular body. The outlet body 184 may be formed from plastic adapted to be deformed by the threads 192 when the inlet body 182 and outlet body 184 are coupled together.

Figure 15:
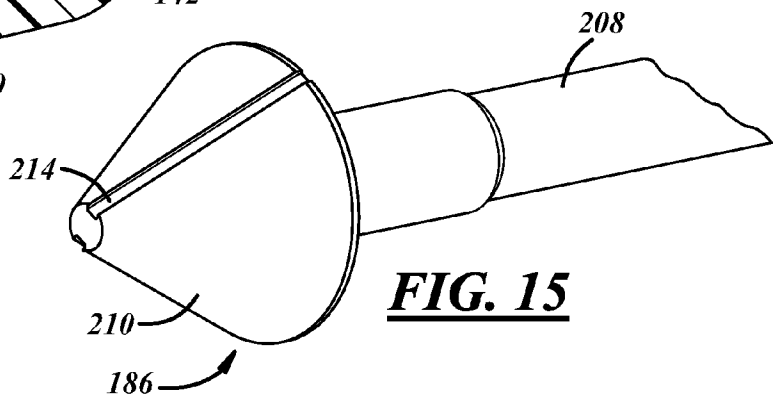
FIG. 15 is an enlarged, fragmentary perspective view of a valve head of the pressure regulator.
Figure 10:
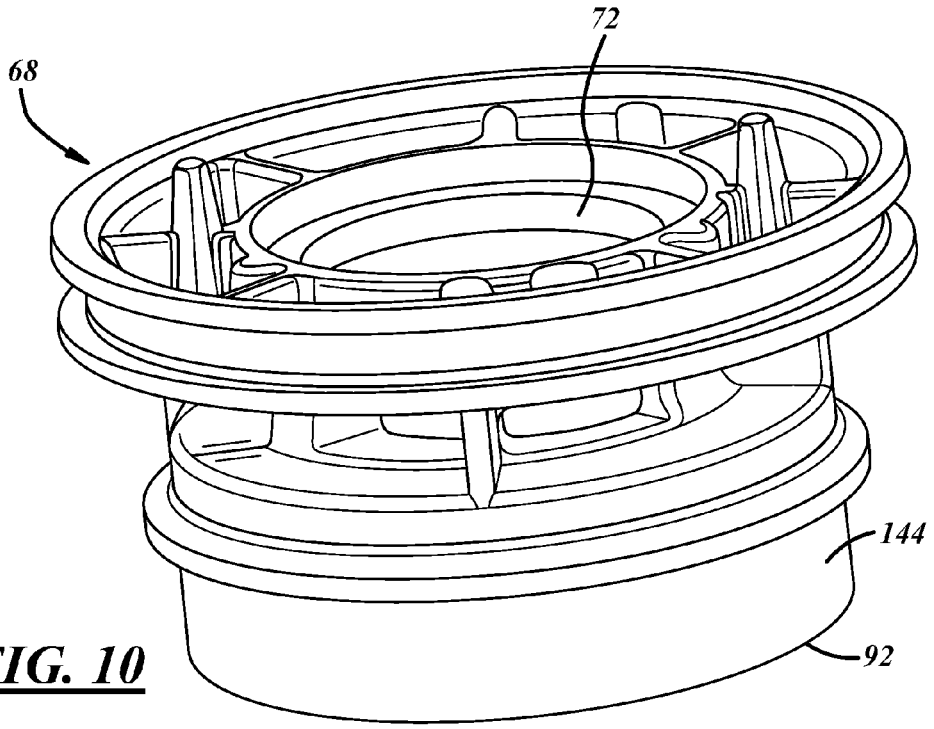
FIG. 10 is a top perspective view of the upper end cap.
Figure 11:
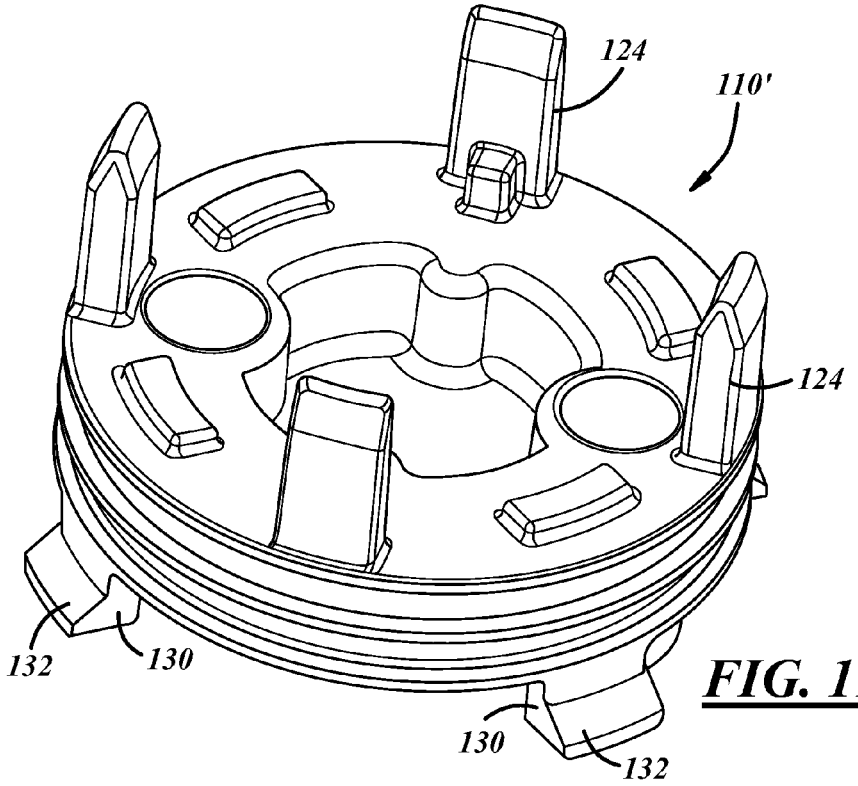
FIG. 11 is an upper perspective view of a lower end cap.
Figure 12:
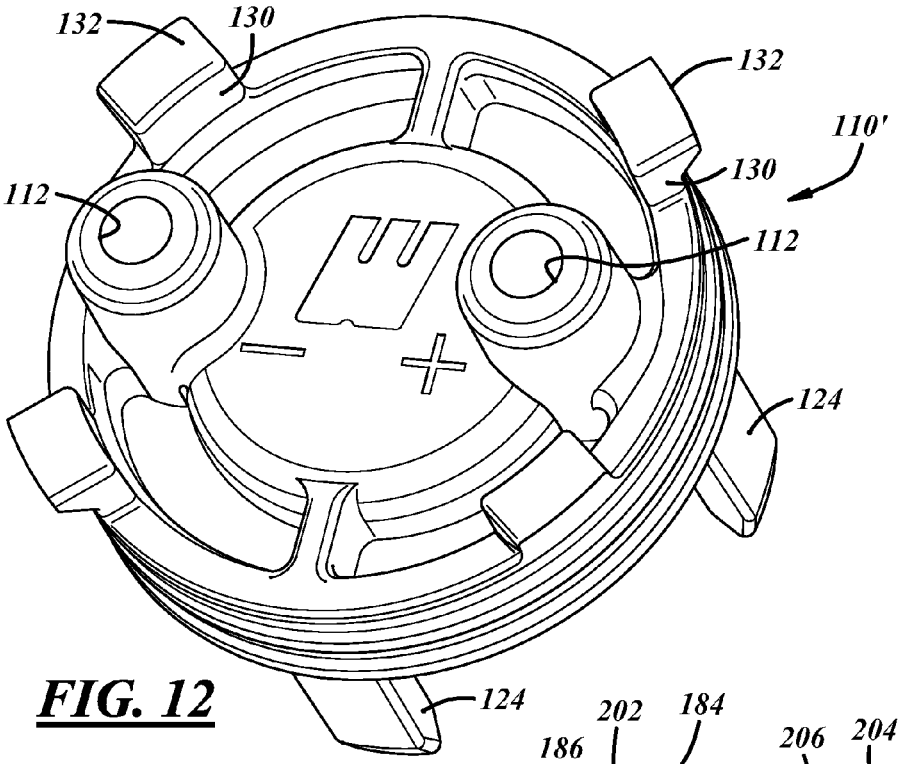
FIG. 12 is a lower perspective view of the lower end cap.
Figure 13:
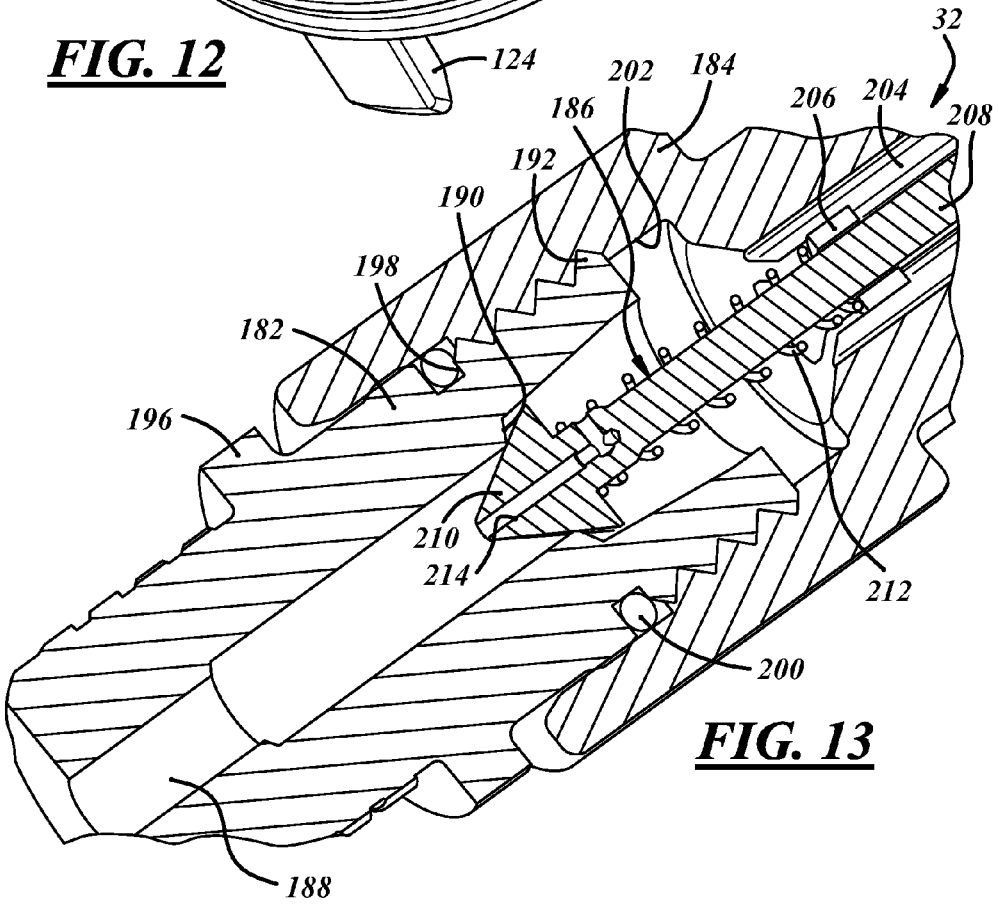
FIG. 13 is an enlarged, fragmentary sectional view of a pressure regulator that may be used with a fuel pump assembly.
Figure 14:
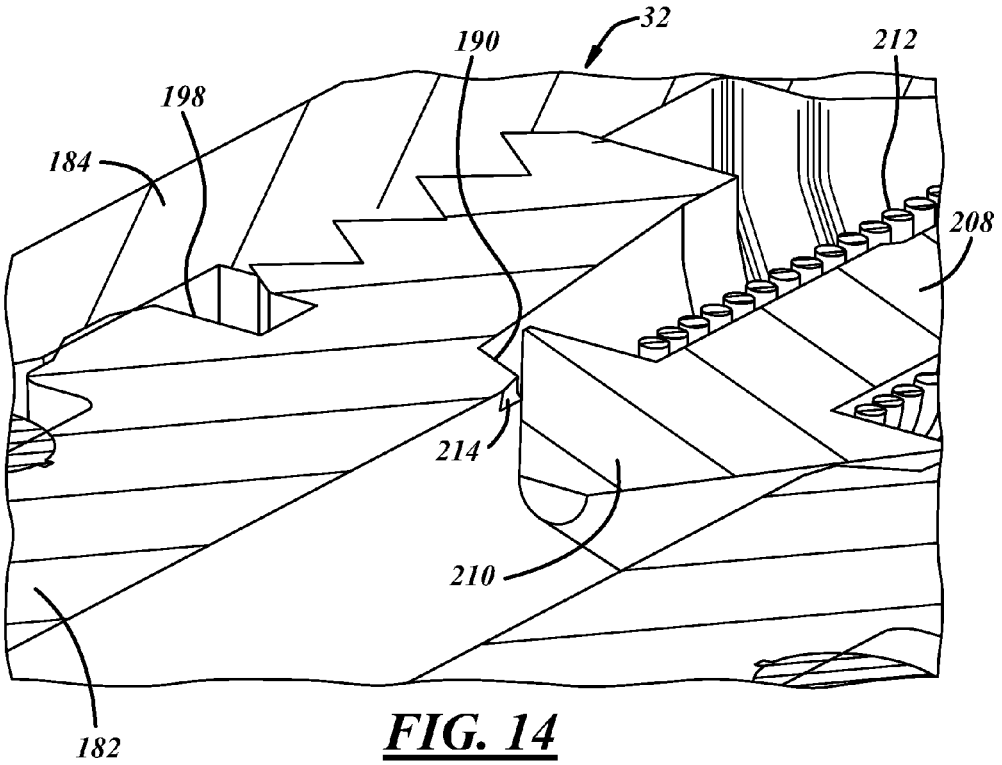
FIG. 14 is an enlarged, fragmentary sectional view of the pressure regulator.
Figure 16:
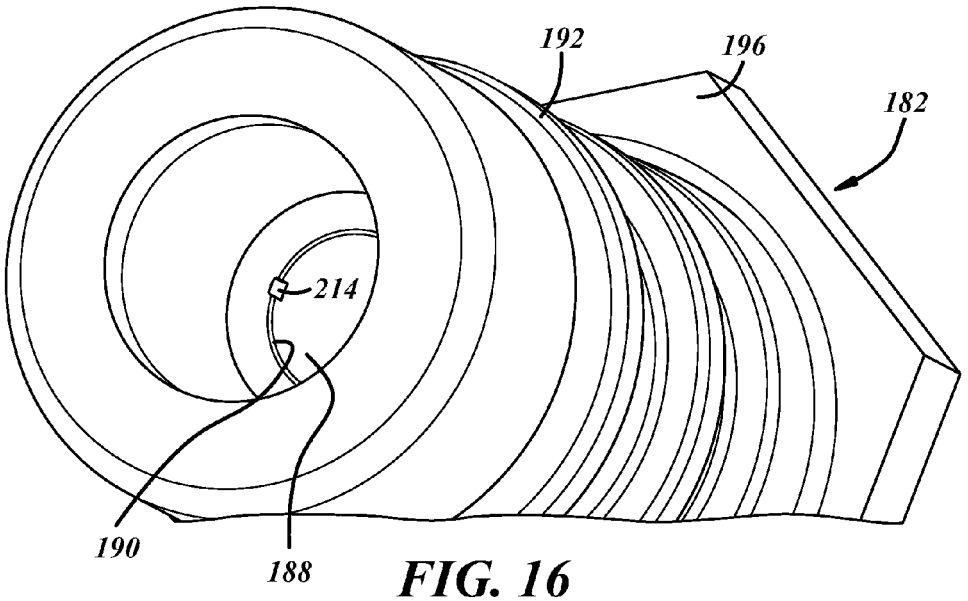
FIG. 16 is an enlarged, fragmentary perspective view of a housing of the pressure regulator.

The valve 186 may include a stem 208, a head 210 and a biasing member 212 such as a spring. The valve stem 208 may be slidably received through the valve retainer 206. The biasing member 212 may engage the valve retainer 206 at one end and the valve head 210 at its other end to provide a force yieldably biasing the valve head 210 toward and into engagement with the valve seat 190. The head 210 may be adapted to engage the seat 190 and at least partially close the inlet passage 188. The head 210 and/or the seat 190 may include a vent passage which may include a void 214, such as a slot or recess or passage that communicates the inlet passage 188 and outlet passage 204 even when the valve head 210 is engaged with the valve seat 190. In FIGS. 13 and 15 the void is shown in the valve head 210 and in FIGS. 14 and 16 the void is shown in the seat 190. This may permit vapor flow through the regulator 32 even when the valve 186 is closed, for example, when the fuel pump 12 is not operating. This venting of vapor may help to reduce the amount of vapor or gaseous fluids in the pump 12 when the pump is off and before the pump is turned on to pump fuel again. And it may also allow vapor to pass or vent as the pump is started but not discharging fluid at full regulator operating pressures.

The second end of the inlet body 182 may be received in the cavity 202, and the cavity may receive the threads 192 to retain the position of the inlet body 182 relative to the outlet body 184 and/or an interference fit may be provided between the inlet and outlet bodies 182, 184 to retain the position of these bodies relative to each other. In one form, the inlet body 182 is formed of metal, such as brass, and the outlet body 184 is formed from a plastic. The threads 192 from the inlet body 182 may press or cut into the outlet body 184 to firmly retain the position of the inlet body relative to the outlet body and inhibit or prevent movement between these bodies after their position is set. In one form, an interference fit may be provided in an area between the threads 192 and flange 196. Thus, a given compression of the spring 212 may be set/calibrated by inserting the second end of the inlet body 182 a certain depth into the cavity 202. This provides a given spring force on the valve head 210 which resists a given fuel pressure acting on the opposite side of the valve head from within the inlet passage 188. In this way, the pressure at which the valve head 210 moves from the valve seat 190 can be controlled, and set from valve-to-valve upon assembly of the pressure regulator 32. Of course, other arrangements of the fuel pressure regulator 32 are possible. For example, the valve seat 190 could be formed by the outlet body 184, or an insert carried by either the inlet or outlet bodies 182, 184, and the outlet body 184 could be formed for metal and include the threads instead of the inlet body 182. Also, the portion of the regulator deformed by the threads 192 could be provided by an insert instead of being an integral portion of one of the inlet body 182 or outlet body 184.

Figure 19:
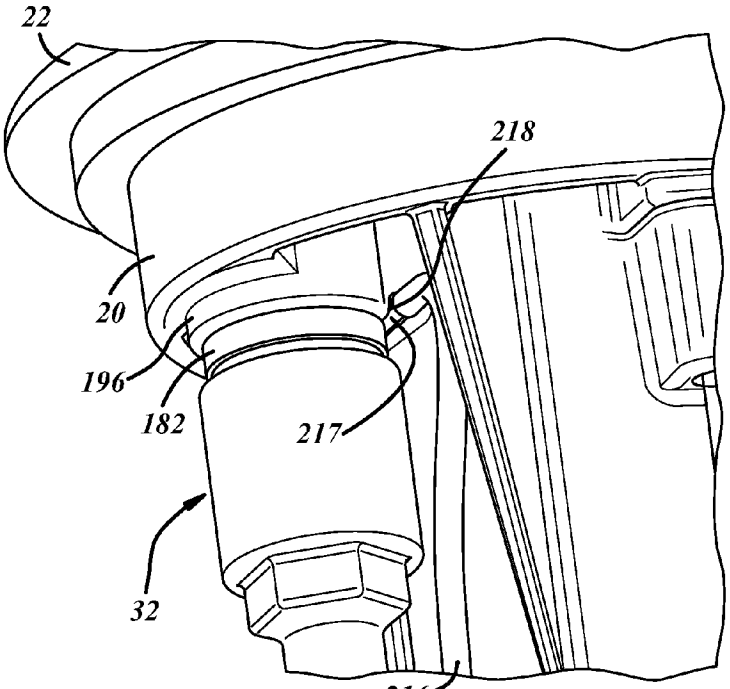
FIG. 19 is a fragmentary perspective view of a portion of a fuel pump assembly showing a pressure regulator carried by a mounting module.

In at least some implementations, as shown in FIG. 19, a wire 216 may extend from the inlet body 182 to a ground to electrically ground the pressure regulator 32 and dissipate any static or other electric charge that may otherwise accumulate on the pressure regulator in use. The wire 216 could be the wire connected to, for example, the negative terminal of the fuel pump motor 40, and a stripped portion 217 of that wire 216 between its ends could be brought into engagement with the fuel pressure regulator 32 to ground the regulator. In one form, a portion of that wire 216 may be received in a groove 218 adjacent to the fuel pressure regulator 32 so that a portion of the wire engages a portion of the fuel pressure regulator to electrically ground the fuel pressure regulator.

Figure 17:
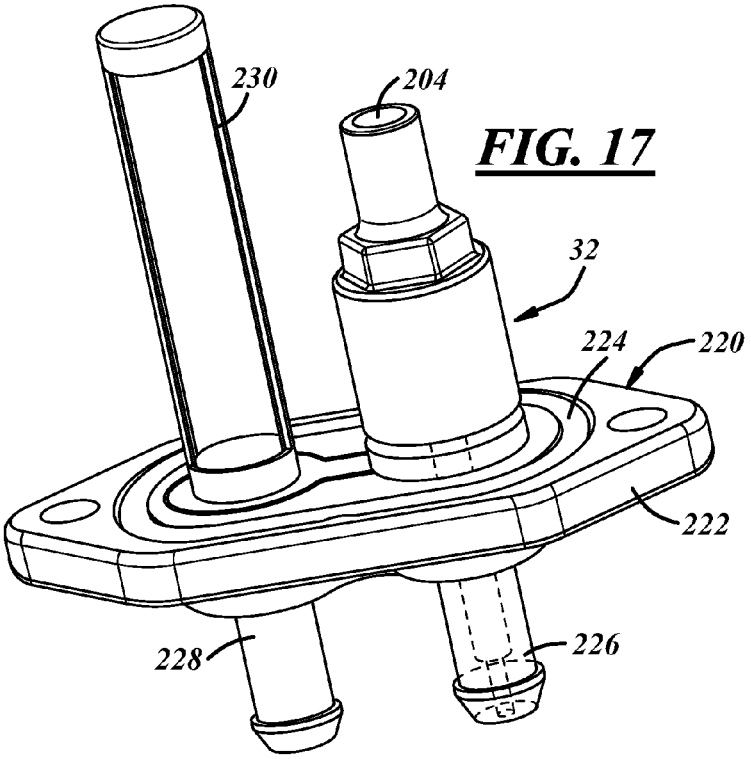
FIG. 17 is a perspective view of a pressure regulator carried by a pit cock that may be installed on a fuel tank.

The pressure regulator 32 could also be carried by a pit cock body 220, as shown in FIG. 17. The pit cock body 220 may include a peripheral flange 222 and seal 224 and is adapted to be received in or against a fuel tank. The pit cock body 220 may define at least part of a first passage 226 leading to the pressure regulator 32 and at least part of a second passage 228 through which fuel flows to the fuel pump inlet. A filter 230 may be disposed on or about the second passage 228 to filter fuel upstream of the fuel pump 12. In this arrangement, the fuel pump 12 may be located outside of the fuel tank. Fuel discharged from the fuel pump 12 is routed to the first passage 226 where the fuel is communicated with pressure regulator 32. If the fuel pressure is above a threshold, then some of the fuel is discharged into the fuel tank through the outlet passage 204 of the pressure regulator 32 which is communicated with, and may be disposed in, the interior of the fuel tank.

Figure 18:
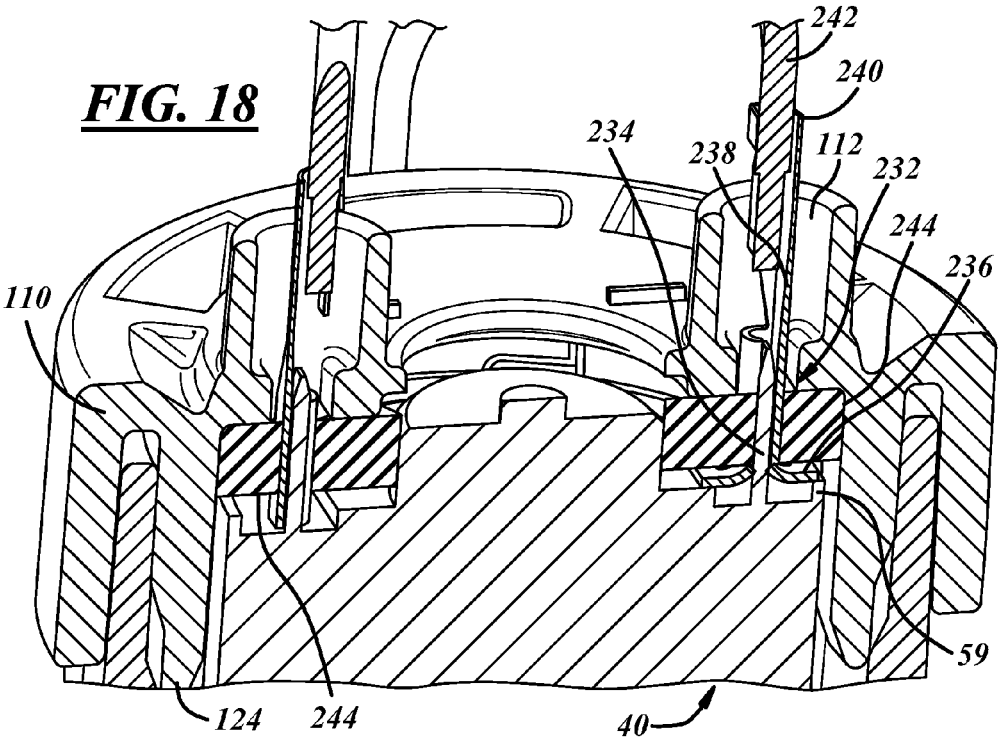
FIG. 18 is a fragmentary perspective view of a fuel pump assembly showing electrical connections to a fuel pump.

As shown in FIG. 18, a fuel pump motor ground element 232 may be provided around a negative terminal 234 of the fuel pump motor 40. The ground element 232 may include a metal clip or outwardly extending flange 236 adapted to engage the motor casing 59, an at least partially tubular connector portion 238 adapted to receive and partially surround the negative terminal 234, and a distal end 240 adapted to be coupled to a negative lead 242 which may be a part of or coupled to the wire 216. The ground element could be formed in one or more pieces (as shown, the clip 236 is separate from the connector portion 238). This electrically couples the negative terminal 234 to the motor casing 59 for static electric charge dissipation. One or more seals 244 could also be provided at or around the terminals to prevent fluid from leaking through openings for the terminals. The terminal seal(s) could be formed of an electrostatic dissipative material, if desired. Or, non-dissipative rubber material may be used for the seal, with a metal coating, foil or substrate bonded to the rubber material to provide a portion of the ground path.

Figure 21:
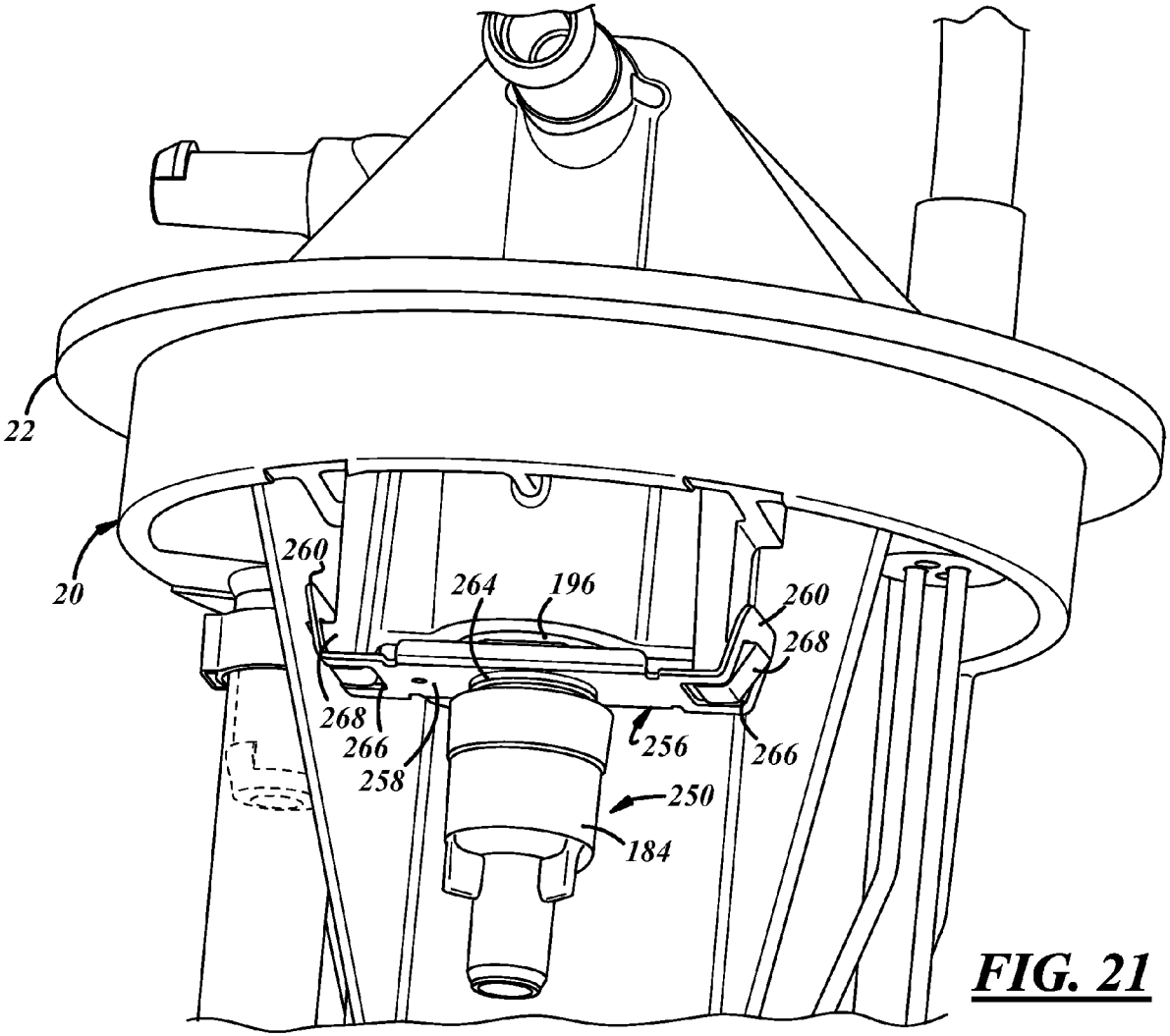
FIG. 21 is a side perspective view of a module including one implementation of a fuel pressure regulator.
Figure 22:
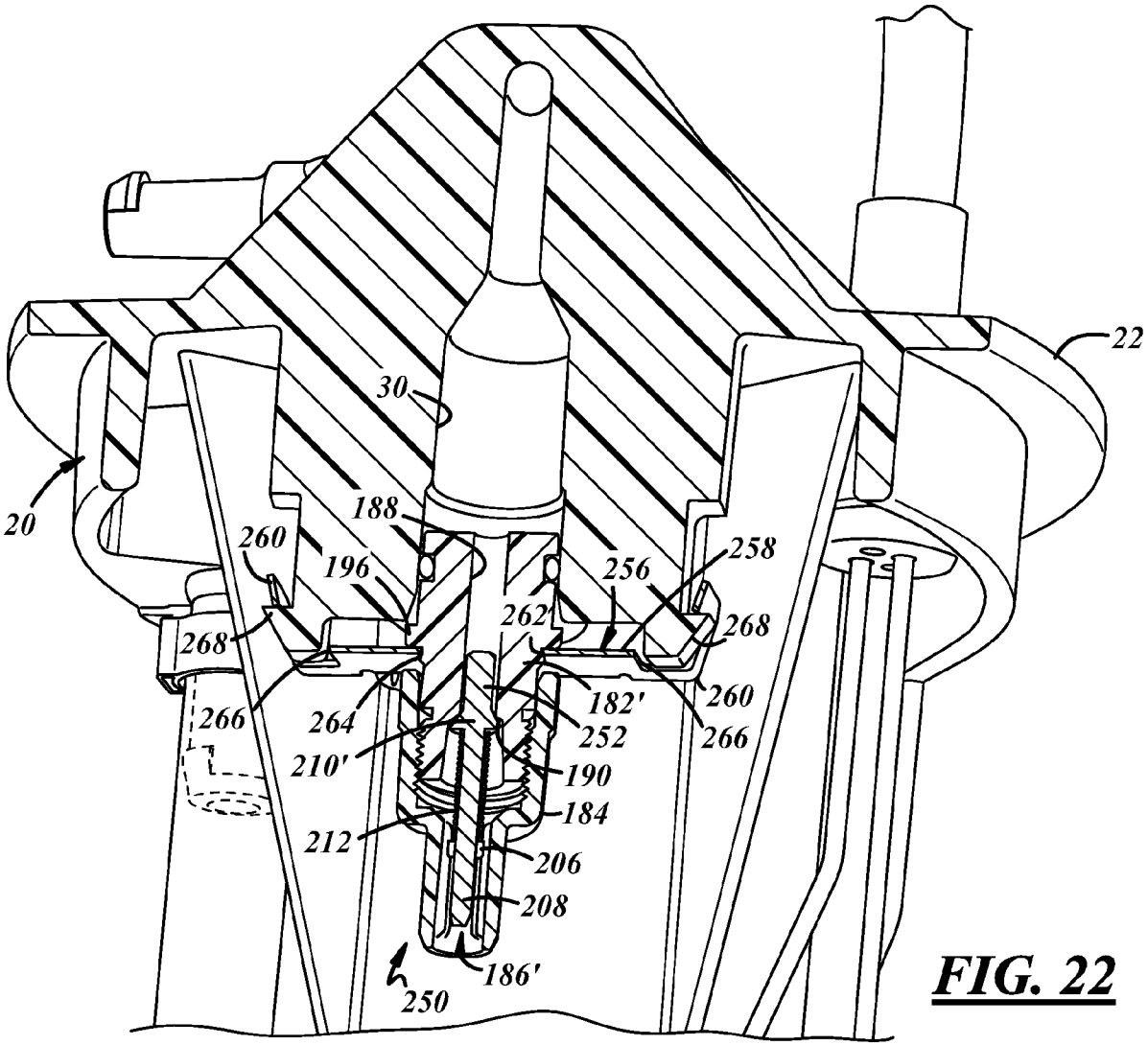
FIG. 22 is a view similar to FIG. 21 but with a portion shown in cross section to show internal components of the fuel pressure regulator.

Another implementation of a fuel pressure regulator 250 is shown in FIGS. 21 and 22. In this implementation, the inlet body 182 and outlet body 184 may be the same as in the pressure regulator 32 previously described. A modified valve head 210' may be shaped differently than the valve head 210 and may have an elongated mass 252 extending beyond the valve seat 190 and into the inlet passage 188 a desired distance or amount. The mass 252 may be formed from the same piece of material as the rest of the valve, or it may be a separate component attached to the valve stem and/or remainder of the valve head. The elongated valve head 210' changes the weight or mass of the valve 186' compared to the valve 186 which changes the natural frequency of the valve 186' and can reduce oscillations or harmonic resonations of the valve 186' in fluid under pressure to provide a more consistent and improved performance of the fuel pressure regulator 250. The mass 252 also may provide a flow restriction between the mass and the inlet body 182 by providing a relatively small or narrower gap between them. This flow restriction may also help reduce harmonic resonations or vibrations of the valve 186'. A void such as the void 214 previously described may, but need not be, provided in one or both of the valve 186 and valve seat 190, as previously discussed.

A retainer 256 may be provided to connect the fuel pressure regulator 252 to the housing 20. The retainer 256 may have a mid-portion 258 coupled to one or both of the inlet and outlet bodies 182, 184 and one or more fingers 260 adapted to be connected to the housing 20. The mid-portion 258 may include an opening 262 and, as shown in FIGS. 21 and 22, may be snap-fit over a ridge 264 and received against the flange 196 of the inlet body 182 to couple the retainer 256 to the inlet body 182. The finger(s) 260 may also have an opening 266 and may be snap-fit over tabs 268 formed on the module housing 20 to couple the retainer to the housing 20. In this way, the fuel pressure regulator 250 (or regulator 32) can be maintained in position relative to the housing 20.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A fuel pump assembly, comprising:

a housing defining at least a portion of a fuel pump cavity having a side wall and an at least substantially closed end;

a fuel pump disposed within the fuel pump cavity and having:

an electric motor;

a pumping element coupled to and driven for rotation by the electric motor;

a pump body having a first end adjacent to the electric motor and a distal end spaced from the electric motor, wherein the pump body maintains the position of the pumping element relative to the electric motor and the housing;

a one-piece flexible seal disposed between the distal end of the pump body and the housing to provide a fluid tight seal between them with a first portion of the flexible seal disposed radially outwardly of the distal end of the pump body and engaging the side wall of the fuel pump cavity with the first portion radially positioning the pump body within the fuel pump cavity and with a second portion of the flexible seal disposed axially outwardly of the distal end of the pump body and engaging the at least substantially closed end of the fuel pump cavity with the second portion axially positioning the pump body within the fuel pump cavity, and the flexible seal is sufficiently flexible to accommodate the maximum variations in size and position of the pump body due to manufacturing tolerances of the electric motor and the pump body.

2. The fuel pump assembly of claim 1 wherein the motor includes a drive shaft, the pump body includes a bore through which the drive shaft extends, and the pump body includes a locating feature for the pumping element where the locating feature is positioned in the pump body relative to the bore.

3. The fuel pump assembly of claim 2 wherein the pump body also includes a base wall that, with the locating feature, defines a cavity in which the pumping element is received, and wherein the motor is disposed on the opposite side of the base wall as the pumping element.

4. The fuel pump assembly of claim 3 wherein the locating feature is a sidewall of the cavity in which the pumping element is received and wherein the pumping element is a gerotor set with the sidewall being eccentric relative to an axis of the bore.

5. The fuel pump assembly of claim 2 wherein the pump body includes a bearing portion that closely receives a portion of the drive shaft to accurately align the pump body and the drive shaft.

6. The fuel pump assembly of claim 1 which also comprises a retainer coupled to the housing and spanning at least part of the fuel pump cavity to retain the fuel pump within the fuel pump cavity.

7. The fuel pump assembly of claim 6 wherein the retainer includes a plurality of spaced apart fingers each having a tab extending laterally from its finger and adapted to be received within an opening in the housing to couple the retainer to the housing.

8. The fuel pump assembly of claim 6 wherein the retainer includes a plurality of spaced apart pegs adapted to be at least partially received within the fuel pump cavity, and when at least partially received within the fuel pump cavity, the pegs are flexed inwardly by the housing to radially center the adjacent end of the fuel pump relative to the fuel pump cavity.

9. The fuel pump assembly of claim 8 wherein the retainer includes a plurality of spaced apart fingers each having a tab extending inwardly from its finger and adapted to be received within an opening in the housing to couple the retainer to the housing.

10. The fuel pump assembly of claim 1 wherein the fuel pump includes an outlet through which pressurized fuel is discharged, and which also includes a fuel pressure regulator having a regulator housing defining a valve seat, a valve head movable relative to the valve seat to control fuel flow through the fuel pressure regulator, and a vent passage defined in one or both of the regulator housing and the valve head to enable vapor flow through the fuel pressure regulator even when the valve head is engaged with the valve seat.

11. The fuel pump assembly of claim 10 wherein the regulator housing of the fuel pressure regulator includes an inlet body and an outlet body coupled to the inlet body by threads, where one of the inlet body and the outlet body is formed from metal and includes the threads and the other of the inlet body and the outlet body is formed from plastic and the plastic is deformed by the metal threads when the inlet body and the outlet body are coupled together.

12. The fuel pump assembly of claim 11 wherein the fuel pressure regulator also includes a biasing member yieldably biasing the valve head toward the valve seat and a force that the biasing member provides onto the valve head varies as the relative position of the inlet body and the outlet body is varied and wherein the threaded engagement between the inlet body and the outlet body maintain the relative position of the inlet body and outlet body to maintain a setting of the force of the biasing member on the valve head.

13. A fuel pump assembly, comprising:

a housing defining at least a portion of a fuel pump cavity and having a generally open end and an inside surface with a plurality of inwardly extending ramp surfaces;

a fuel pump disposed within the fuel pump cavity and having:

an electric motor including a drive shaft;

a pumping element adjacent the open end of the fuel pump cavity and coupled to and driven for rotation by the drive shaft;

a pump body having a bore through which the drive shaft extends with the bore radially locating the drive shaft and pumping element relative to the pump body, and including a locating feature locating the bore relative to the pump body where the locating feature is formed in one piece with the pump body; and a retainer coupled to the housing adjacent to and spanning at least part of the open end of the fuel pump cavity to retain the fuel pump at least partially within the fuel pump cavity, the retainer includes a plurality of pegs each constructed to engage a respective one of the ramp surfaces and be flexed by such respective ramp surface to thereby position the retainer relative to the fuel pump cavity and to radially align the adjacent electric motor end of the fuel pump relative to the fuel pump cavity.

14. The fuel pump assembly of claim 13 wherein the locating feature includes a wall of the pump body that is formed at the same time as the bore to locate the wall relative to the bore.

15. The fuel pump assembly of claim 14 wherein the wall defines at least part of a cavity in which the pumping element is received.

16. The fuel pump assembly of claim 15 wherein the pumping element includes a gerotor set and the cavity is not coaxial with the bore.

17. The fuel pump assembly of claim 13 including a fuel pressure regulator, comprising:

a housing defining a valve seat;

a valve head movable relative to the valve seat to control fuel flow through the fuel pressure regulator;

the housing includes an inlet body and a separate outlet body coupled to the inlet body by threads, where one of the inlet body and the outlet body is formed from metal and includes metal threads and the other of the inlet body and the outlet body is formed from plastic; and an interference fit is provided between the metal threads of the one body and plastic of the other body and plastic is displaced by the metal threads when the bodies are coupled together; and a biasing member yieldably biasing the valve head toward the valve seat and the force that the biasing member provides onto the valve head varies as the relative position of the inlet body and the outlet body is varied and wherein the threaded engagement between the inlet body and the outlet body maintain the relative position of the inlet body and outlet body to maintain a set force of the biasing member on the valve head.

18. The fuel pump assembly of claim 17 wherein the fuel pressure regulator includes a vent passage defined in one or both of the housing and the valve head to enable vapor flow through the fuel pressure regulator even when the valve head is engaged with the valve seat.

19. The fuel pump assembly of claim 17 wherein the inlet body and the outlet body of the fuel pressure regulator are axially coupled together where movement of one body relative to the other body changes the axial length of the housing and the axial length of the biasing member.

20. The fuel pump assembly of claim 17 wherein the valve head of the fuel pressure regulator includes an elongated mass extending beyond the valve seat and into an outlet passage downstream of the valve seat.

21. A fuel pump assembly, comprising:

a main housing defining at least part of a fuel pump cavity;

a fuel pump disposed at least partially within the fuel pump cavity and having:

a metal casing;

an electric motor received at least partially within the metal casing and having a drive shaft, a negative terminal and a positive terminal to which wires are connected to provide power to the electric motor to rotate the drive shaft;

a pumping element coupled to and driven for rotation by the drive shaft to discharge fuel under pressure through an outlet; and an electrical ground element coupled to the negative terminal and an electrical wire coupled to the negative terminal, and having a portion electrically engaging the metal casing; and a fuel pressure regulator carried by the main housing downstream of the fuel pump and having a regulator housing with an inlet through which fuel discharged from the fuel pump is received, and a valve carried by the regulator housing to control the pressure of fuel downstream of the fuel pressure regulator, the main housing having a groove adjacent to the fuel pressure regulator housing and in which a portion of the wire connected to the negative terminal is received, with a portion of the wire electrically engaging the regulator housing of the fuel pressure regulator to ground the fuel pressure regulator.

22. The fuel pump assembly of claim 17 which also includes a seal including an electrically dissipative material that, with the ground element, defines part of a grounding path for the electric motor.

* * * * *

UNITED STATES PATENT AND TRADEMARK OFFICE

CERTIFICATE OF CORRECTION

PATENT NO. : 8,939,736 B2
APPLICATION NO. : 13/307879
DATED : January 27, 2015
INVENTOR(S) : Kevin L. Israelson et al.

It is certified that error appears in the above-identified patent and that said Letters Patent is hereby corrected as shown below:

In the Claims

Column 12, Line 53, change “claim 17” to “claim 21”.

Signed and Sealed this
Twenty-sixth Day of May, 2015

Michelle K. Lee

Michelle K. Lee
*Director of the United States Patent and Trademark Office*